US006925832B2

(12) United States Patent
Kitaura et al.

(10) Patent No.: US 6,925,832 B2
(45) Date of Patent: Aug. 9, 2005

(54) HIGH-LOW PRESSURE DOME TYPE COMPRESSOR

(75) Inventors: Hiroshi Kitaura, Sakai (JP); Masanori Yanagisawa, Sakai (JP); Kazuhiko Matsukawa, Sakai (JP); Toshiyuki Toyama, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/486,902

(22) PCT Filed: Mar. 11, 2003

(86) PCT No.: PCT/JP03/02879

§ 371 (c)(1),
(2), (4) Date: Feb. 17, 2004

(87) PCT Pub. No.: WO03/083302

PCT Pub. Date: Oct. 9, 2003

(65) Prior Publication Data

US 2004/0197209 A1 Oct. 7, 2004

(30) Foreign Application Priority Data

Mar. 28, 2002 (JP) ..... 2002-092036

(51) Int. Cl.[7] ..... F25B 13/00
(52) U.S. Cl. ..... 62/324.6; 417/410.5; 418/55.1
(58) Field of Search ..... 62/323.3, 324.6, 62/505, 508; 417/366, 410.5; 418/55.1

(56) References Cited

U.S. PATENT DOCUMENTS 4,518,324 A * 5/1985 Mizuno et al. ..... 417/366
4,596,521 A * 6/1986 Murayama et al. ..... 418/55.1
5,263,822 A * 11/1993 Fujio ..... 418/55.4
5,395,214 A * 3/1995 Kawahara et al. ..... 417/53
5,503,542 A * 4/1996 Grassbaugh et al. ..... 418/55.1
5,591,018 A * 1/1997 Takeuchi et al. ..... 417/366
5,836,746 A * 11/1998 Maruyama et al. ..... 417/44.1
5,980,222 A * 11/1999 Fry ..... 417/553
6,042,346 A * 3/2000 Doi ..... 417/371
6,467,296 B2 * 10/2002 Fujii et al. ..... 62/324.6
6,595,760 B2 * 7/2003 Shida et al. ..... 417/410.1

FOREIGN PATENT DOCUMENTS

JP 362093495 A * 4/1987
JP 3-63677 10/1991
JP 7-310677 11/1995
JP 08303363 A * 11/1996
JP 2620409 3/1997
JP 10-47268 2/1998
JP 2001-20865 1/2001
JP 2001-153072 6/2001
JP 2001-329978 11/2001

* cited by examiner

*Primary Examiner*—Harry B. Tanner
*Assistant Examiner*—Mohammad M. Ali
(74) *Attorney, Agent, or Firm*—Shinjyu Global IP Counselors, LLP

(57) ABSTRACT

Formed in a scroll type compression mechanism is a connection passageway with a discharge opening through which refrigerant compressed by the compression mechanism flows out into a clearance space defined between the compression mechanism and a drive motor. A muffler space in communication with the connection passageway that is configured to reduce operating noise is formed in the compression mechanism. A motor cooling passageway configured to circulate working fluid which has flowed out into the clearance space is formed between the drive motor and an inner surface area of a casing. A guide plate is disposed in the clearance space. Formed in the guide plate is a flow dividing concave portion which causes a part of refrigerant flowing toward the motor cooling passageway to be distributed in a circumferential direction and toward an internal end of a discharge pipe located in the clearance space.

22 Claims, 9 Drawing Sheets

HIGH-LOW PRESSURE DOME TYPE COMPRESSOR

TECHNICAL FIELD

The present invention relates generally to high-low pressure dome type compressors. This invention pertains more particularly to measures aimed at providing a compression mechanism with a simplified construction, and at making improvement in efficiency of cooling a drive motor.

BACKGROUND ART

High-low pressure dome type compressors have been known in the prior art. For example, Japanese Patent Kokai Gazette No. (1995)310677 discloses one such compressor in which its casing internal space is divided into a high-and low-level pressure spaces facing each other across a compression mechanism and a drive motor drivingly connected to the compression mechanism is disposed in the high-level pressure space. This type of high-low pressure dome type compressor is provided with an internal discharge pipe for guiding working fluid compressed by the compression mechanism to the high-level pressure space. And, a discharge pipe, through which refrigerant in the high-level pressure space is discharged outside the casing, is connected to the casing. An outflow end of the internal discharge pipe is located in a clearance space defined between the compression mechanism and the drive motor.

PROBLEMS THAT INVENTION INTENDS TO SOLVE

However, a high-low pressure dome type compressor of the above-described conventional type requires provision of such an internal discharge pipe for guiding working fluid compressed by a compression mechanism to a high-level pressure space. As a result of this, the number of component parts required increases and it is required that the casing outside diameter be increased. Therefore, it is difficult to provide a compressor with a compact construction.

Further, since it is arranged such that the outflow end of the internal discharge pipe is located in a clearance space defined between the compression mechanism and the drive motor, the working fluid fails to cool the drive motor at high efficiency.

On the other hand, in order to make improvement in capacity of cooling a drive motor, it is conceivable that, instead of employing an internal discharge pipe as described above, a working fluid passageway is provided in the inside of a drive shaft so that working fluid is guided, through the working fluid passageway, to a lower space of the drive motor. In this case, however, the drive shaft falls lower in its rigidity and the level of operating nose is increased by shaft vibration caused by discharge pulsation. Furthermore, problems, such as an increase in the number of processing steps of the drive shaft and an increase in the number of sealing-related component parts, arise.

Bearing in mind the above-described problems with the prior art techniques, the present invention was made. Accordingly, an object to the present invention is to provide a high-low pressure dome type compressor with a compact construction as well as to cool a drive motor at high efficiency.

DISCLOSURE OF INVENTION

In order to achieve the foregoing object, the present invention discloses an arrangement in which a connection passageway (46), through which working fluid compressed in a compression chamber (40) of a compression mechanism (15) flows out into a high-level pressure space (28), is formed in the compression mechanism (15), and working fluid discharged from the connection passageway (46) circulates through a motor cooling passageway (55) formed between a drive motor (16) and an inner surface area of a casing (10).

More specifically, a first invention of the present application is directed to a high-low pressure dome type compressor in which an internal space of a casing (10) is divided into a high-and low-level pressure spaces (28) and (29) facing each other across a compression mechanism (15) and a drive motor (16) drivingly connected to the compression mechanism (15) is disposed in the high-level pressure space (28). In the high-low pressure dome type compressor of the first invention, a connection passageway (46), through which working fluid compressed in a compression chamber (40) of the compression mechanism (15) flows out into a clearance space (18) defined between the compression mechanism (15) and the drive motor (16), is formed in the compression mechanism (15), and a motor cooling passageway (55), through which working fluid which has flowed out of the connection passageway (46) circulates between the clearance space (18) and a side of the drive motor (16) which is opposite to the compression mechanism (15), is formed between the drive motor (16) and an inner surface area of the casing (10).

Further, in a second invention of the present application according to the first invention, the compression mechanism (15) is provided with a muffler space (45) which is formed between the compression chamber (40) for working fluid compression and the connection passageway (46).

Furthermore, in a third invention of the present application according to either the first invention or the second invention, a guide plate (58), for guiding working fluid which has flowed out of the connection passageway (46) to the motor cooling passageway (55), is disposed in the clearance space (18).

Further, in a fourth invention of the present application according to the third invention, the casing (10) is provide with a discharge pipe (20) through which working fluid in the high-level pressure space (28) is discharged outside the casing (10), and the guide plate (58) is provided with flow dividing means (90) for allowing a part of working fluid flowing toward the motor cooling passageway (55) to be distributed in a circumferential direction and for guiding the distributed working fluid to an internal end (36) of a discharge pipe (20) located in the clearance space (18).

Furthermore, in a fifth invention of the present application according to the fourth invention, the internal end (36) of the discharge pipe (20) projects inward beyond an inner surface area of the casing (10).

Further, in a sixth invention of the present application according to any one of the first to fifth inventions, the compression mechanism (15) comprises a fixed scroll (24) and a housing member (23) for housing a movable scroll (26) which matingly engages with the fixed scroll (24), and the housing member (23) is hermetically joined to an inner surface area of the casing (10) over an entire circumferential periphery thereof.

Furthermore, in a seventh invention of the present application according to the sixth invention, the connection passageway (46) is so formed as to have a transverse cross section shaped like a circular arc.

Further, in an eighth invention of the present application according to either the sixth invention or the seventh invention, the connection passage (46) is so formed as to extend from the fixed scroll (24) to the housing member (23), and fastening apertures (80), for insertion of bolts (38) for fastening together the fixed scroll (24) and the housing member (23), are formed in the fixed scroll (24) and the housing member (23), and the connection passageway (46) and fastening apertures (80) adjacent to both casing circumferential-direction sides of the connection passageway (46) respectively are formed such that a center of a straight line (82) connecting together centers of the fastening apertures (80) lies within the connection passageway (46) in a joint surface between the fixed scroll (24) and the housing member (23).

Furthermore, in a ninth invention of the present application according to the eighth invention, the connection passageway (46) and fastening apertures (80) adjacent to both casing circumferential-direction sides of the connection passageway (46) respectively are formed such that a center of a straight line (82) connecting together centers of the fastening apertures (80) corresponds to a center (83) of the connection passageway (46) in a joint surface between the fixed scroll (24) and the housing member (23).

WORKING

In the first invention, working fluid compressed by the compression mechanism (15) circulates in the connection passageway (46) formed in the compression mechanism (15) and flows out into the clearance space (18) defined between the compression mechanism (15) and the drive motor (16). At least a part of the working fluid which has flowed out into the clearance space (18) flows through the motor cooling passageway (55) between the drive motor (16) and the casing's (10) inner surface and circulates between the clearance space (18) and a side of the drive motor (16) which is opposite to the compression mechanism (15), whereby the drive motor (16) is cooled.

As a result of such arrangement, the drive motor (16) is cooled efficiently by working fluid without increasing the number of component parts. Besides, it is possible to compactly prepare the compressor (1). Furthermore, problems resulting from forming a working fluid passageway in a drive shaft, such as a decrease in shaft rigidity and discharge pulsation, will not arise.

Further, in the second invention according to the first invention, working fluid compressed in the compression chamber (40) of the compression mechanism (15) passes through the muffler space (45) and thereafter circulates through the connection passageway (46). Accordingly, during the time that working fluid flows into the connection passageway (46) from the compression chamber (40), operating noise is reduced. Therefore, it is possible to provide a compact, low noise level compressor (1) without increasing the number of component parts.

Furthermore, in the third invention according to either the first invention or the second invention, working fluid which has flowed through the connection passageway (46) and thereafter flowed out into the clearance space (18) between the compression mechanism (15) and the drive motor (16) is guided to the motor cooling passageway (55) by the guide plate (58) disposed in the clearance space (18). This ensures that working fluid is guided to the motor cooling passageway (55), thereby making it possible to efficiently cool the drive motor (16) without fail.

Further, in the fourth invention according to the third invention, a part of working fluid which has flowed through the connection passageway (46) and thereafter flowed out into the clearance space (18) between the compression mechanism (15) and the drive motor (16), is distributed in a circumferential direction by the flow dividing means (90), thereby flowing toward the internal end (36) of the discharge pipe (20) located in the clearance space (18). The remaining working fluid flows through the motor cooling passageway (55) between the drive motor (16) which is a DC motor and the casing's (10) inner surface. Accordingly, it is possible to secure cooling of the drive motor (16) while making improvement in efficiency of separating lubricant from working fluid, for example when the drive motor (16) of low temperature rise is employed.

Furthermore, in the fifth invention according to the fourth invention, lubricant discharging is controlled. In other words, with regard to working fluid flowing in circumference direction, the closer to the vicinity of the casing's (10) inner surface the higher the concentration of lubricant becomes. In the fifth invention, since the discharge pipe (20) projects inward of the casing (10), this makes it possible to suppress inflow of lubricant and working fluid to the discharge pipe (20). As a result, it is possible to suppress discharging of lubricant from the compressor (1).

Further, in the sixth invention according to any one of the first to fifth inventions, the housing member (23) is hermetically joined to an inner surface area of the casing (10) over an entire circumferential periphery thereof This ensures that the internal space of the casing (10) is divided into the high-level pressure space (28) and the low-level pressure space (29). Further, it is ensured that both working fluid leakage and working-fluid suction heating are avoided. And, while the fixed scroll (24) and the movable scroll (26) housed in the housing member (23) are matingly engaging with each other, the compression mechanism (15) is driven, whereby working fluid is compressed. The working fluid thus compressed passes through the connection passageway (46) and is discharged to the high-level pressure space (28).

Furthermore, in the seventh invention according to the sixth invention, the connection passageway (46) has a transverse cross section shaped like a circular arc. This makes it possible to increase the flowpath area of the connection passageway (46) while suppressing radial-direction expansion of the compression mechanism (15).

Further, in the eighth invention according to either the sixth invention or the seventh invention, the connection passageway (46) and fastening apertures (80) adjacent to both casing circumferential-direction sides of the connection passageway (46) are formed such that a center of a straight line (82) connecting together centers of the fastening apertures (80) lies within the connection passageway (46) in a joint surface between the fixed scroll (24) and the housing member (23). This ensures sealing of the fixed scroll (24) and the housing member (23), thereby preventing leakage of high-pressure fluid in the connection passageway (46) into the low-level pressure space (29) without fail.

Furthermore, in the ninth invention according to the eighth invention, the connection passageway (46) and fastening apertures (80) adjacent to both casing circumferential-direction sides of the connection passageway (46) are formed such that a center of a straight line (82) connecting together centers of the fastening apertures (80) corresponds to a center (83) of the connection passageway (46) in a joint surface between the fixed scroll (24) and the housing member (23). This ensures sealing of the fixed scroll (24) and the housing member (23), thereby preventing leakage of high-pressure fluid in the connection passageway (46) into the low-level pressure space (29) without fail.

EFFECTS OF INVENTION

In accordance with the first invention, the drive motor (16) is cooled efficiently by working fluid without increasing the number of component parts. Besides, it is possible to compactly prepare the compressor (1). Furthermore, problems resulting from forming a working fluid passageway in a drive shaft, such as a decrease in shaft rigidity and discharge pulsation, will not arise.

In accordance with the second invention, it is arranged such that, during the time that working fluid flows into the connection passageway (46) from the compression chamber (40), operating noise is reduced. Therefore, it is possible to provide a compact, low noise level compressor (1) without increasing the number of component parts.

In accordance with the third invention, working fluid is guided to the motor cooling passageway (55) without fail, thereby ensuring that the drive motor (16) is cooled at high efficiency.

In accordance with the fourth invention, it is possible to secure cooling of the drive motor (16) while making improvement in efficiency of separating lubricant from working fluid, for example when the drive motor (16) of low temperature rise is employed.

In accordance with the fifth invention, it is possible to suppress inflow of lubricant and working fluid into the discharge pipe (20), and it is possible to suppress discharging of lubricant from the compressor (1).

In accordance with the sixth invention, the internal space of the casing (10) is divided into the high-level pressure space (28) and the low-level pressure space (29) without fail. Both working fluid leakage and working-fluid suction heating are prevented without fail.

In accordance with the seventh invention, the connection passageway (46) has a transverse cross section shaped like a circular arc, thereby making it possible to increase the flowpath area of the connection passageway (46) while suppressing radial-direction expansion of the compression mechanism (15).

The eighth and ninth inventions each ensure sealing of the fixed scroll (24) and the housing member (23), thereby preventing leakage of high-pressure fluid in the connection passageway (46) into the low-level pressure space (29) without fail.

BRIEF DESCRIPTION OF DRAWINGS

FIG. 6 shows an entire arrangement of a guide plate in the first embodiment wherein

FIG. 10 shows an entire arrangement of a guide plate in a second embodiment of the present invention wherein

BEST MODE FOR CARRYING OUT INVENTION

Hereinafter, embodiments of the present invention will be described in detail with reference to the drawings.

Embodiment 1

Figure 1:
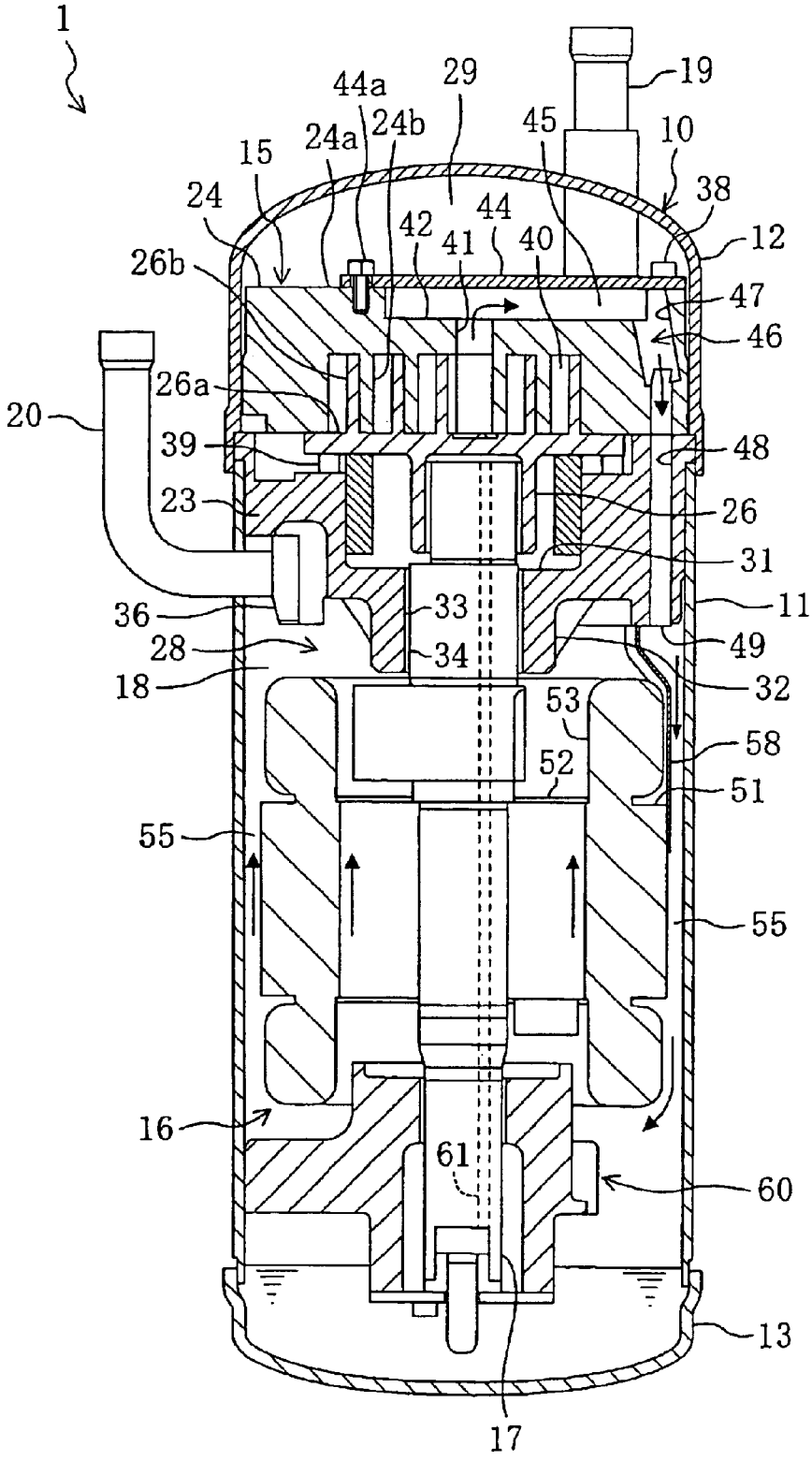
FIG. 1 is a longitudinal sectional view showing an entire arrangement of a high-low pressure dome type compressor according to a first embodiment of the present invention.

FIG. 1 shows a high-low pressure dome type compressor (1) according to the present embodiment. The high-low pressure dome type compressor (1) is connected to a refrigerant circuit (not shown) in which refrigerant gas circulates to execute a refrigerating cycle and compresses refrigerant gas serving as working fluid.

The compressor (1) of the present embodiment comprises an oblong cylinder-like, hermetically sealed dome type casing (10). The casing (10), made up of a casing main body (11) which is a cylindrical trunk part having an axis line extending in an up-and-down direction, a saucer-shaped upper wall part (12) which is joined hermetically and integrally to an upper end of the casing main body (11) by welding and which has a convex surface projecting upward, and a saucer-shaped lower wall part (13) which is joined hermetically and integrally to a lower end of the casing main body (11) by welding and which has a convex surface projecting downward, is constructed as a pressure container. The interior of the casing (10) is hollow.

The casing (10) accommodates therein a compression mechanism (15) for compressing refrigerant gas and a drive motor (16) disposed below the compression mechanism (15). The compression mechanism (15) and the drive motor (16) are connected together by a drive shaft (17) which is so disposed as to extend in an up-and-down direction within the casing (10). Defined between the compression mechanism (15) and the drive motor (16) is a clearance space (18).

The compression mechanism (15) comprises a housing (23) serving as a housing member, a fixed scroll (24) which is so disposed as to be fitted closely to an upper part of the housing (23), and a movable scroll (26) which matingly engages with the fixed scroll (24). The housing (23) is secured by press fitting to the casing main body (11) over an entire circumferential periphery thereof In other words, the casing main body (11) and the housing (23) are closely joined together over the entire circumferential periphery. And, the internal space of the casing (10) is divided into a high-level pressure space (28) below the housing (23) and a low-level pressure space (29) above the housing (23). A housing concave portion (31) is formed concavedly in the middle of an upper surface of the housing (23), and a bearing part (32) is formed so as to extend downward from the middle of a lower surface of the housing (23). And, a bearing aperture (33) passing through a lower end surface of the bearing part (32) and a bottom surface of the housing concave portion (31) is formed in the housing (23), and the drive shaft (17) is inserted rotatably into the bearing aperture (33) through a bearing (34).

A suction pipe (19) for guiding refrigerant in the refrigerant circuit to the compression mechanism (15) is fitted hermetically to the upper wall part (12) of the casing (10). A discharge pipe (20), through which refrigerant in the casing (10) is discharged outside the casing (10), is fitted hermetically to the casing main body (11). The suction pipe (19) passes through the low-level pressure space (29) in an up-and-down direction and its internal end is fitted to the fixed scroll (24). Since the suction pipe (19) is so disposed as to pass through the low-level pressure space (29), this prevents refrigerant from being heated by refrigerant present in the inside of the casing (10) when being drawn in to the compression mechanism (15) through the suction pipe (19).

An internal end (36) of the discharge pipe (20) projects inward beyond an inner surface area of the casing (10). And, the internal end (36) of the discharge pipe (20) is formed into a cylindrical shape extending in an up-and-low direction and is secured firmly to the lower end of the housing (23). An internal end opening of the discharge pipe (20), i.e., an inflow opening, opens downward. Additionally, the shape of the internal end (36) of the discharge pipe (20) is not limited to a cylindrical shape. For example, the internal end (36) of the discharge pipe (20) may be formed into a triangular shape in longitudinal cross section which is longer at its lower end in the tip of the discharge pipe (20). In this case, the internal end opening of the discharge pipe (20) opens upward.

A lower end surface of the fixed scroll (24) is jointed closely to an upper end surface of the housing (23). The fixed scroll (24) is fastened firmly to the housing (23) by bolts (38).

The fixed scroll (24) is made up of an end plate (24*a*) and an involute wrap (24*b*) formed in a lower surface of the end plate (24*a*). On the other hand, the movable scroll (26) is made up of an end plate (26*a*) and an involute wrap (26*b*) formed in an upper surface of the end plate (26*a*). The movable scroll (26) is supported on the housing (23) through an Oldham ring (39). The upper end of the drive shaft (17) is fitted into the movable scroll (26), and the movable scroll (26) does not rotate on its axis but executes an orbital motion within the housing (23) by rotation of the drive shaft (17). The wrap (24*b*) of the fixed scroll (24) and the wrap (26*b*) of the movable scroll (26) matingly engage with each other. Between the fixed scroll (24) and the movable scroll (26), a clearance between contacting parts of the wraps (24*b*, 26*b*) becomes a compression chamber (40). The compression chamber (40) is formed such that the volume between the wraps (24*b*, 26*b*) shrinks toward the center with the revolution of the movable scroll (26) so that refrigerant is compressed.

Formed in the end plate (24*a*) of the fixed scroll (24) are a discharge passageway (41) in communication with the compression chamber (40) and an enlarged concave portion (42) extending to the discharge passageway (41). The discharge passageway (41) is so formed as to extend in an up-and-down direction in the middle of the end plate (24*a*) of the fixed scroll (24). The enlarged concave portion (42) is composed of a concave portion formed concavedly in an upper surface of the end plate (24*a*) and extending in a horizontal direction. A covering member (44) is fastened firmly to the upper surface of the fixed scroll (24) by bolts (44*a*) so as to block off the enlarged concave portion (42). And, covering of the enlarged concave portion (42) with the covering member (44) defines a muffler space (45) composed of an expansion chamber for reducing the level of operating noise of the compression mechanism (15). The fixed scroll (24) and the covering member (44) are sealed by closely jointing them together through a gasket (not shown).

A connection passageway (46) is formed in the compression mechanism (15), extending from the fixed scroll (24) to the housing (23). A scroll side passageway (47) notch-formed in the fixed scroll (24) and a housing side passageway (48) notch-formed in the housing (23) communicate with each other, thereby forming the connection passageway (46). An upper end of the connection passageway (46), i.e., an upper end of the scroll side passageway (47), opens to the enlarged concave portion (42), while a lower end of the connection passageway (46), i.e., a lower end of the housing side passageway (48), opens to the lower end surface of the housing (23). In other words, the lower end opening of the housing side passageway (48) is a discharge opening (49) through which refrigerant in the connection passageway (46) flows out into the clearance space (18).

The drive motor (16) is composed of a DC motor comprising an annular stator (51) secured firmly to an internal wall surface area of the casing (10) and a rotor (52) rotatably disposed interior to the stator (51). Defined between the stator (51) and the rotor (52) is a small gap (not shown) extending in an up-and-down direction. This gap is an air gap passageway. Mounted on the stator (51) is a winding, and upper and lower parts of the stator (51) are coil ends (53). The drive motor (16) is disposed such that an upper end of the upper coil end (53) is substantially flush with a lower end of the bearing (32) of the housing (23).

A plurality of core cut parts are notch-formed in areas of an outer peripheral surface of the stator (51), extending from the upper end surface to the lower end surface of the stator (51) at predetermined circumferential intervals. By the formation of the core cut parts in the outer peripheral surface of the stator (51), a motor cooling passageway (55) extending in an up-and-down direction is formed between the casing main body (11) and the stator (51).

The rotor (52) is drivingly connected to the movable scroll (26) of the compression mechanism (15) through the drive shaft (17) which is so disposed on the axial center of the casing main body (11) as to extend in an up-and-down direction.

Disposed in the clearance space (18) is a guide plate (58) for guiding refrigerant flowed out of the discharge opening (49) of the connection passageway (46) to the motor cooling passageway (55). Details of the guide plate (58) will be described later.

Defined below the drive motor (16) is a lower space for holding lubricant. A centrifugal pump (60) is disposed in the lower space. The centrifugal pump (60) is secured firmly to the casing main body (11) and is attached to the lower end of the drive shaft (17). The centrifugal pump (60) draws up lubricant. A lubrication passageway (61) is formed within the drive shaft (17), and lubricant drawn up by the centrifugal pump (60) passes through the lubrication passageway (61) and is supplied to each sliding parts.

Figure 2:
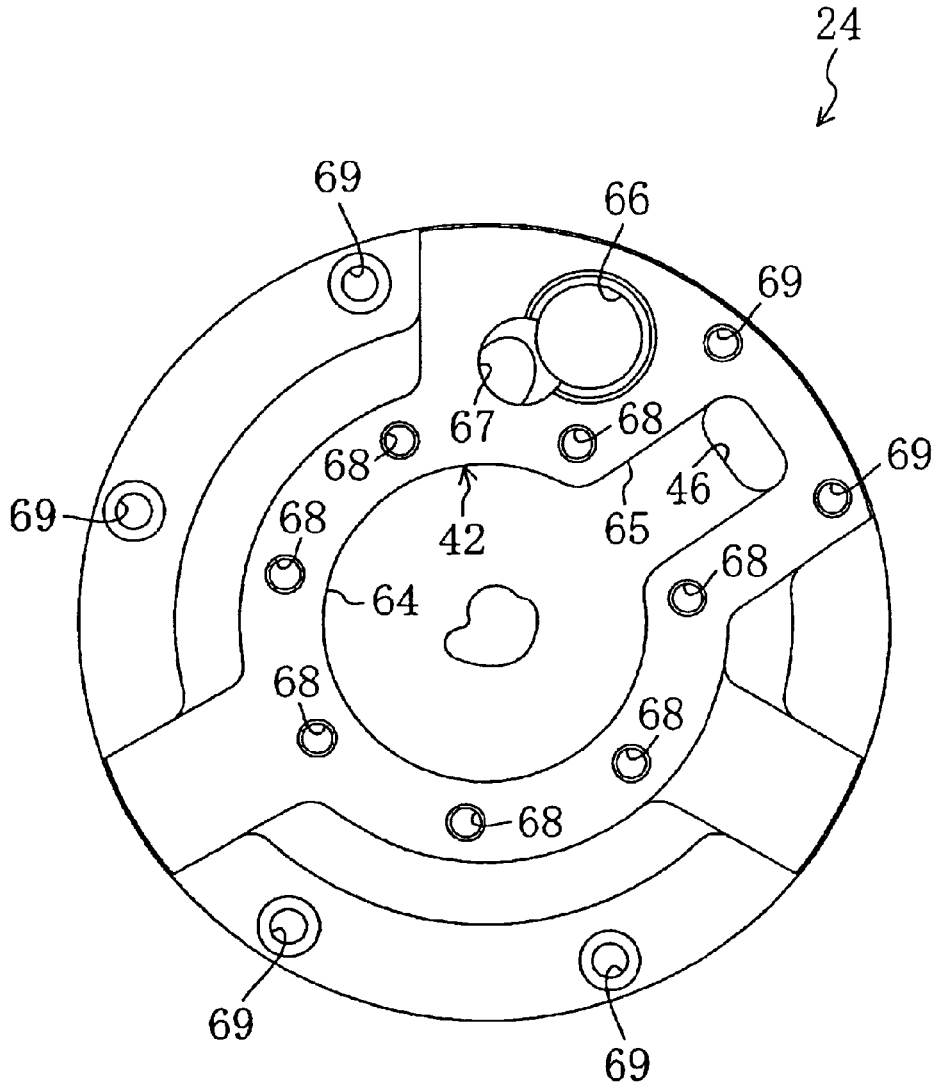
FIG. 2 is a top plan view showing an upper surface of a fixed scroll.

As shown in FIG. 2, the enlarged concave portion (42) of the fixed scroll (24) comprises a central concave portion (64) shaped like a circular when viewed from top and an extendedly-formed concave portion (65) extending radially outwardly from the central concave portion (64). The upper end of the scroll side passageway (47) opens at an outer end of the extendedly-formed concave portion (65), assuming a shape which is elongated relative to a circumferential direction. The periphery of the central concave portion (64) and the extendedly-formed concave portion (65) forms the upper end surface of the fixed scroll (24). Formed around the periphery of the central concave portion (64) in the upper end surface of the fixed scroll (24) are fastening apertures (68) to which the bolts (44*a*) for fastening and fixing of the covering member (44) are threadedly engaged. Additionally, formed at an outer peripheral end of the fixed scroll (24) are a plurality of fastening apertures (69) to which the bolts (38) for fastening of the housing (23) to the fixed scroll (24) are threadedly engaged. Two of these fastening apertures (69) are located in the vicinity of the extendedly-formed concave portion (65).

Additionally, a suction aperture (66) is formed in the fixed scroll (24). The suction aperture (66) is located in close vicinity to the extendedly-formed concave portion (65). The upper surface of the fixed scroll (24) and the compression chamber (40) are brought into communication with each other by the suction aperture (66). The suction pipe (19) is fitted into the suction aperture (66). Furthermore, an auxiliary suction aperture (67) is formed adjacent to the suction aperture (66) in the fixed scroll (24). The low-level pressure space (29) and the compression chamber (40) are brought into communication with each other by the auxiliary suction aperture (67).

Figure 3:
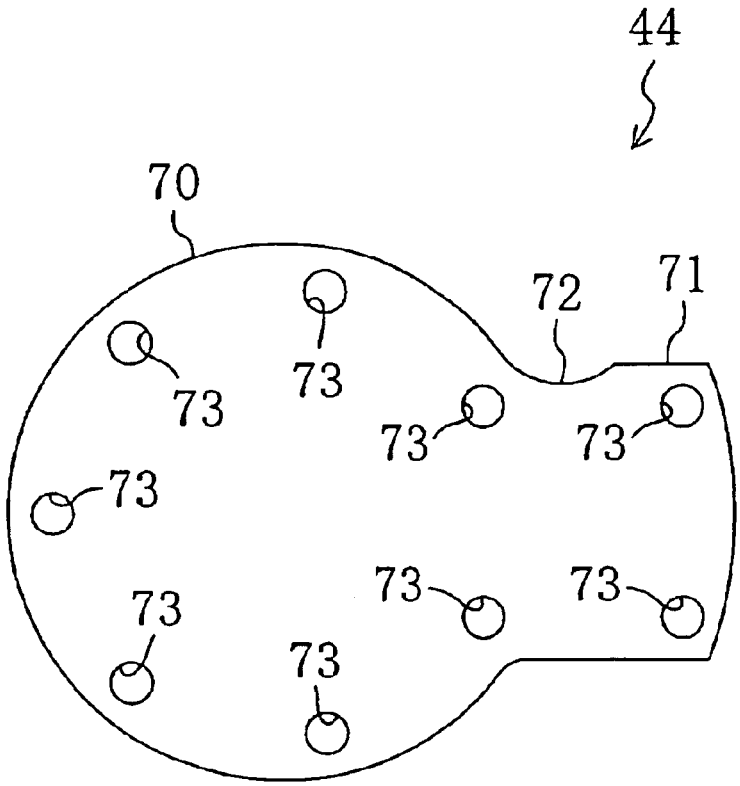
FIG. 3 is a top plan view of a covering member.

As can be seen from FIG. 3, the covering member (44) comprises a circular covering member main body (70) and an extendedly-formed part (71) extending radially outwardly from the covering member main body (70). Formed at an internal side end of the extendedly-formed part (71) is a suction concave portion (72) concavedly formed so as to have a circular arc-like shape with a diameter corresponding to the outside diameter of the suction pipe (19). Fastening apertures (73), to which the bolts (44*a*) for fixing of the cover member (44) to the fixed scroll (24) are threadedly engaged, are formed in a peripheral edge of the covering member main body (70) and in the vicinity of both corners of an outer side end of the extendedly-formed part (71).

Figure 4:
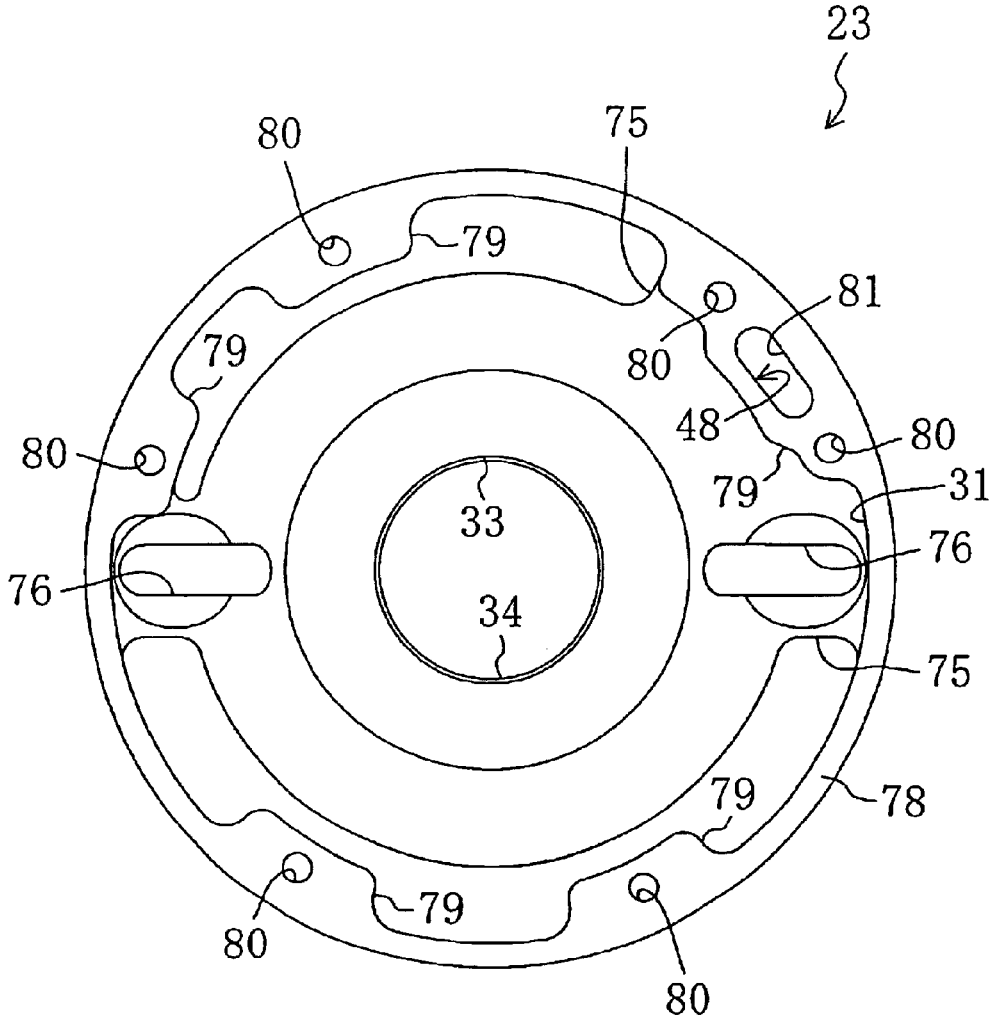
FIG. 4 is a top plan view showing an upper surface of a housing.

As shown in FIG. 4, formed in the housing concave portion (31) of the housing (23) are an outer peripheral concave portion (75) which is formed concavedly from the upper surface so as to extend in a circumferential direction at the outer peripheral end, and a pair of Oldham grooves (76) for fitting of an Oldham ring (39). The Oldham grooves (76) are so formed as to face each other. Each Oldham groove (76) is formed into an oval shape.

An outer peripheral part (78) around the periphery of the housing concave portion (31) has an upper surface which constitutes the upper end surface of the housing (23) and which is formed joinably to the lower end surface of the fixed scroll (24). In other words, the upper surface of the outer peripheral part (78) and the lower end surface of the fixed scroll (24) are sealed, thereby preventing refrigerant in the high-level pressure space (28) from leaking into the low-level pressure space (29). Formed in the outer peripheral part (78) at predetermined circumferential intervals are a plurality of fixing parts (79) extending radially inwardly. Fastening apertures (80), to which the bolts (38) for fixing of the fixed scroll (24) are threadedly engaged, are formed in the fixing parts (79). The fastening apertures (80) are formed in positions corresponding to the fastening apertures (69) formed at the outer peripheral end of the fixed scroll (24).

Formed in one of the fixing parts (79) is an upper end opening (81) of the housing side passageway (48) constituting the connection passageway (46). The upper end opening (81) is shaped like a circular arc which is elongated relative to the casing circumferential direction. Two of the fastening apertures (80) are arrayed in the vicinity of both circumferential-direction ends of the upper end opening (81), i.e., longitudinal-direction ends.

Figure 5:
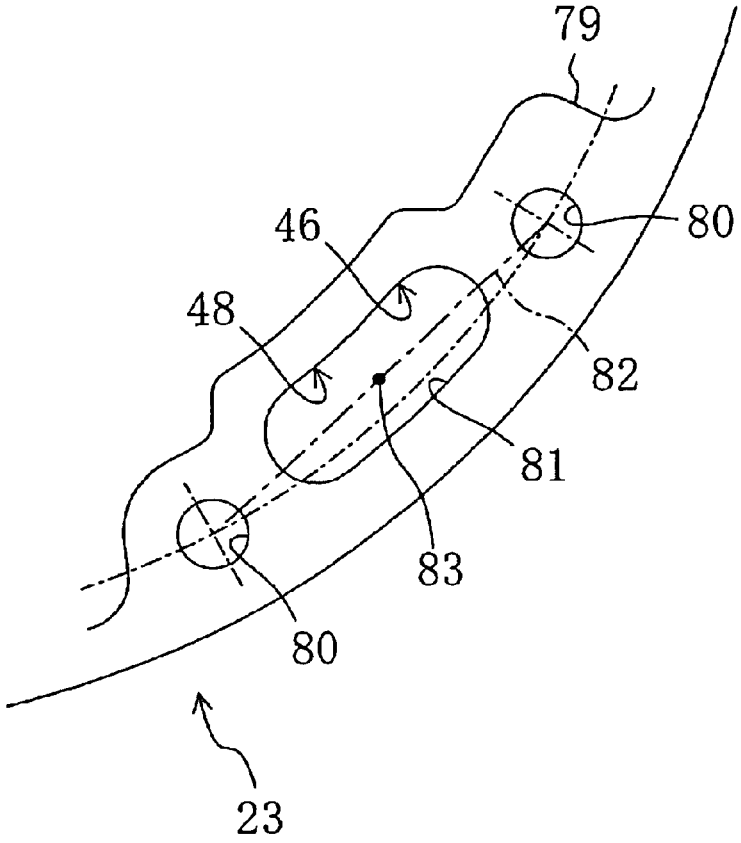
FIG. 5 is a partially enlarged view showing a positional relationship between fastening apertures and an upper end opening of a scroll side passageway in a fixing part of the housing.

As shown in FIG. 5, these two fastening apertures (80) are arrayed such that a straight line (82) connecting together the centers of the fastening apertures (80) intersects with a straight line (82a) passing through the center (83) of the upper end opening (81) and extending in a radial direction, at the center (83) of the upper end opening (81). Stated another way, in a joint surface between the fixed scroll (24) and the housing (23), the connection passageway (46) and the fastening apertures (80) adjacent to both casing circumferential-direction sides of the connection passageway (46) respectively are formed such that the center of the straight line (82) connecting together the centers of the fastening apertures (80) corresponds to the center (83) of the connection passageway (46) (the upper end opening (81) of the housing side passageway (48)).

Figure 6A:
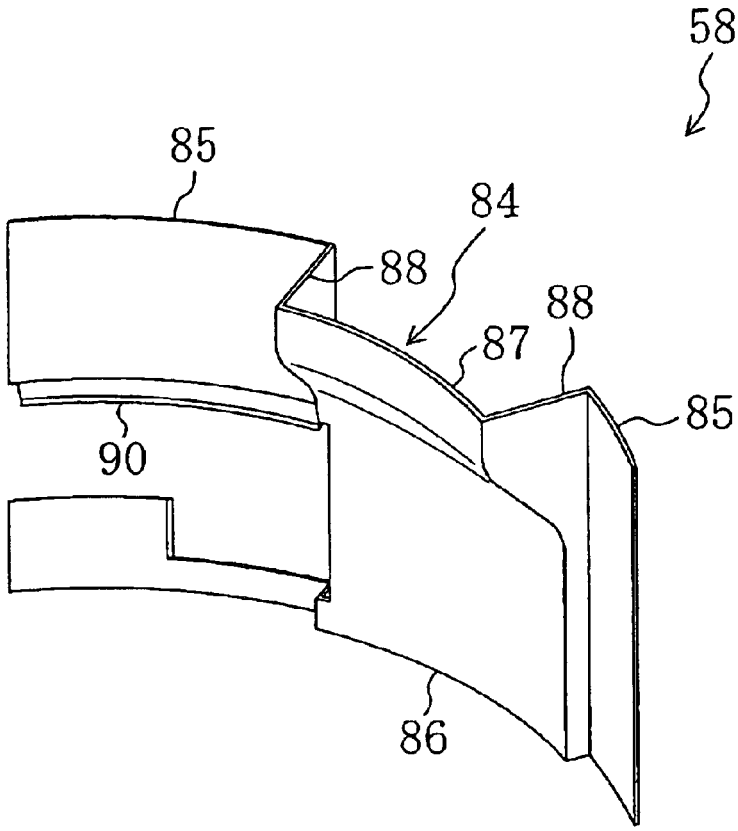
FIG. 6A is a perspective diagram when viewed from the front side and FIG. 6B is a perspective diagram when viewed from the rear side.
Figure 6B:
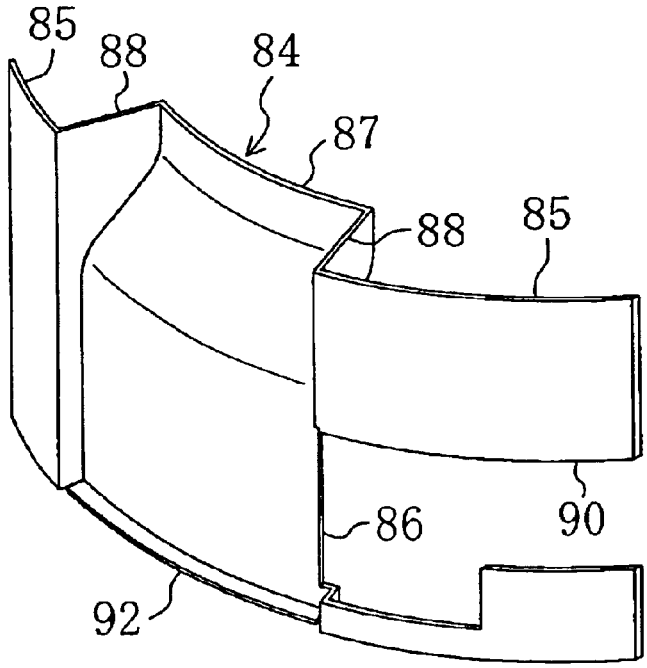
Figure 7:
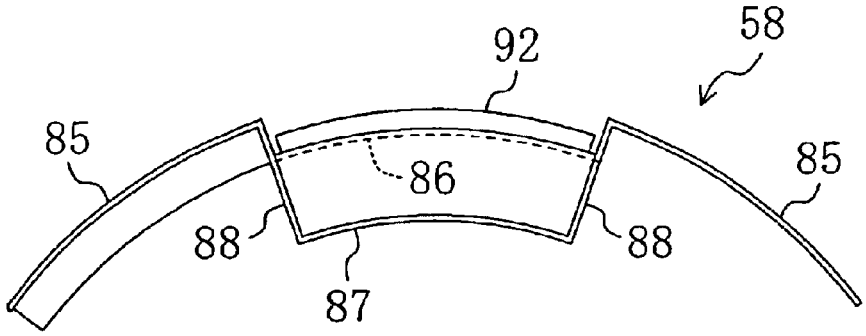
FIG. 7 is a top plan view of the guide plate in the first embodiment.

The guide plate (58) disposed in the clearance space (18) is made up of a guide main body (84) and winglike parts (85) disposed at both ends of the guide main body (84), as shown in FIGS. 6 and 7. The guide main body (84) comprises a lower curved plate (86) having a transverse cross section shaped like a circular arc and extending linearly in an up-and-down direction, a protruding part (87) connected to an upper end of the lower curved plate (86) and formed so as to flare more inward as closer to its upper end, and a side wall part (88) formed vertically toward the outer peripheral side at both ends of the lower curved plate (86) and the protruding part (87). The lower curved plate (86) is disposed exterior to the stator (51) of the drive motor (16). The amount of flaring of the protruding part (87) is adjusted such that the protruding part (87) is located interior to the housing side passageway (48) of the connection passageway (46). In other words, it is arranged such that refrigerant flows, from top down, outside the guide main body (84) of the guide plate (58).

The winglike part (85) is joined to an outer peripheral side end of the side wall part (88) of the guide main body (84) and is so formed as to have a transverse cross section shaped like a circular arc and to extend linearly in an up-and-down direction. The winglike part (85) is so formed as to have a diameter corresponding to that of the inner surface of the casing main body (11). The winglike part (85) is mounted on the casing main body (11).

A flow dividing concave portion (90) is formed in the guide plate (58). The flow dividing concave portion (90) constitutes a flow dividing means and extends from the winglike part (85) to the side wall part (88) of the guide main body (84). A part of refrigerant flowing to the motor cooling passageway (55) is distributed in a circumferential direction by the flow dividing concave portion (90) so that it flows toward the internal end (36) of the discharge pipe (20). The flow dividing concave portion (90) is so formed as to extend from one of the side ends of the winglike part (85) to the side wall part (88) jointed to the lower curved plate (86) of the guide main body (84). The flow dividing concave portion (90) is a notched concave portion.

Further, the guide plate (58) is provided with a turn-back part (92) which flares toward the outer peripheral side at the lower end of the lower curved plate (86) of the guide plate (84). The tip of the turn-back part (92) is so formed as to be located nearer to the inner peripheral side than the both winglike parts (85). The amount of flaring of the turn-back part (92) is set such that the amount of distribution of refrigerant to the flow dividing concave portion (90) is adjusted to a predetermined ratio.

Next, the operation of the high-low pressure dome type compressor (1) will be described below.

In the first place, when the drive motor (16) is activated, the rotor (52) starts rotating relative to the stator (51), whereby the drive shaft (17) rotates. When the drive shaft (17) rotates, the movable scroll (26) does not rotate relative to the fixed scroll (24) but executes only an orbital motion. As a result of this, low-pressure refrigerant is drawn, through the suction pipe (19), into the compression chamber (40) from the side of a peripheral edge of the compression chamber (40). With the variation in volume of the compression chamber (40), the refrigerant is compressed to a high level pressure. The high-pressure refrigerant is discharged to the muffler space (45) from the central part of the compression chamber (40) through the discharge passageway (41). Then, the refrigerant flows into the connection passageway (46) from the muffler space (45), flows through the scroll side passageway (47) and the housing side passageway (48), and flows out into the clearance space (18) through the discharge opening (49).

The refrigerant in the clearance space (18) flows downward between the guide main body (84) of the guide plate (58) and the inner surface of the casing main body (11), during which time a part of the refrigerant is distributed, passes through the flow dividing concave portion (90), and flows between the guide plate (58) and the drive motor (16) in a circumferential direction. The refrigerant thus distributed flows in a circumferential direction, so that its lubricant content is separated. Since the concentration of lubricant is high especially in the vicinity of the internal wall surface of the casing (10), lubricant separates well from the refrigerant near the internal wall.

On the other hand, the refrigerant flowing downward flows downward through the motor cooling passageway (55) to the motor lower space. And, the refrigerant reverses its flow direction and flows upward through the air gap passageway between the stator (51) and the rotor (52) or through the motor cooling passageway (55) on the opposite side (the left-hand side in FIG. 1) to the connection passageway (46).

In the clearance space (18), refrigerant which has passed through the flow dividing concave portion (90) of the guide plate (58) and refrigerant which has flowed through the air gap passageway or the motor cooling passageway (55) flow into each other, flow into the discharge pipe (20) from the internal end (36) of the discharge pipe (20), and are discharged outside the casing (10). And, the refrigerant thus discharged outside the casing (10) circulates in the refrigerant circuit and, thereafter, is again drawn, through the suction pipe (19), into the compressor (1) where the refrigerant is compressed. Such circulation is carried out repeatedly.

As has been described, in accordance with the high-low pressure dome type compressor (1) of the first embodiment, refrigerant compressed by the compression mechanism (15) circulates through the connection passageway (46) formed in the housing (23) and fixed scroll (24) of the compression mechanism (15) and flows out into the clearance space (18) between the compression mechanism (15) and the drive motor (16) through the discharge opening (49). A part of the refrigerant which has flowed out into the clearance space (18) flows through the motor cooling passageway (55) between the drive motor (16) and the casing's (10) inner surface and circulates between the clearance space (18) and a side of the drive motor (16) which is opposite to the compression mechanism (15), whereby the drive motor (16) is cooled.

Accordingly, the drive motor (16) is cooled efficiently by refrigerant without increasing the number of component parts. Besides, it is possible to compactly prepare the compressor (1). Furthermore, problems resulting from forming a working fluid passageway in a drive shaft, such as a decrease in shaft rigidity and discharge pulsation, will not arise.

Furthermore, refrigerant compressed in the compression chamber (40) of the compression mechanism (15), after passing through the muffler space (45), flows through the connection passageway (46). Accordingly, during the time that refrigerant circulates from the compression chamber (40) to the connection passageway (46), operating noise is reduced. Therefore, it is possible to provide a compact, low noise level compressor (1) without increasing the number of component parts.

Further, refrigerant, which has flowed through the connection passageway (46) and flowed out into the clearance space (18) through the discharge opening (49), is guided to the motor cooling passageway (55) by the guide plate (58) disposed in the clearance space (18). This ensures that refrigerant is guided to the motor cooling passageway (55), thereby ensuring that the drive motor (16) is cooled efficiently.

If it is arranged such that all the refrigerant which has flowed out into the clearance space (18) circulates in the motor cooling passageway (55), this reverses the flow direction of the refrigerant in a lower space of the motor. As a result, the amount of refrigerant flowing upward through the motor cooling passageway (55) increases, and it becomes difficult for lubricant to flow downward through the motor cooling passageway (55). However, if, as in the first embodiment, it is arranged such that the flow of refrigerant is divided and a part thereof is distributed by the flow dividing concave portion (90) of the guide plate (58) disposed in the clearance space (18), this makes it possible for lubricant to easily flow downward through the motor cooling passageway (55).

Furthermore, a part of refrigerant which has flowed through the connection passageway (46) and flowed out into the clearance space (18) through the discharge opening (49) is so distributed by the flow dividing concave portion (90) formed in the guide plate (58) as to flow in a circumferential direction while flowing toward the internal end of the discharge pipe (20) located in the clearance space (18). The remaining refrigerant flows through the motor cooling passageway (55) between the drive motor (16) composed of a DC motor and the casing's (10) inner surface. Accordingly, it is possible to secure cooling of the drive motor (16) of low temperature rise and, at the same time, the efficiency of separation of lubricant contained in refrigerant is improved by causing the refrigerant to flow in a circumferential direction.

Further, with regard to refrigerant flowing in a circumference direction, the closer to the vicinity of the casing's (10) inner surface the higher the concentration of lubricant becomes. However, it is arranged such that the internal end (36) of the discharge pipe (20) projects inward beyond the inner surface of the casing main body (11), thereby making it possible to suppress inflow of lubricant into the discharge pipe (20) together with refrigerant. As a result, it is possible to suppress discharging of lubricant from the compressor (1) together with refrigerant.

Furthermore, in the present embodiment, the housing (23) is hermetically joined, at its outer peripheral surface, to the casing main body (11) over an entire circumferential periphery thereof This ensures that the inside of the casing (10) is divided into the high-level pressure space (28) and the low-level pressure space (29). Both refrigerant leakage and refrigerant suction heating are prevented without fail.

Further, in the present embodiment, the connection passageway (46) has a transverse cross section shaped like a circular arc. This makes it possible to increase the flowpath area of the connection passageway (46) while suppressing radial-direction expansion of the compression mechanism (15).

Furthermore, in the present embodiment, in a joint surface between the fixed scroll (24) and the housing (23), the connection passageway (46) and fastening apertures (80) adjacent to both casing circumferential-direction sides of the connection passageway (46) are formed such that the center of the straight line (82) connecting together the centers of the fastening apertures (80) corresponds to the center (83) of the connection passageway (46). Such arrangement ensures that the fixed scroll (24) and the housing (23) are sealed off from each other, and high-pressure fluid in the connection passageway (46) is prevented from leaking into the low-level pressure space (29).

MODIFICATION EXAMPLE 1

Figure 8:
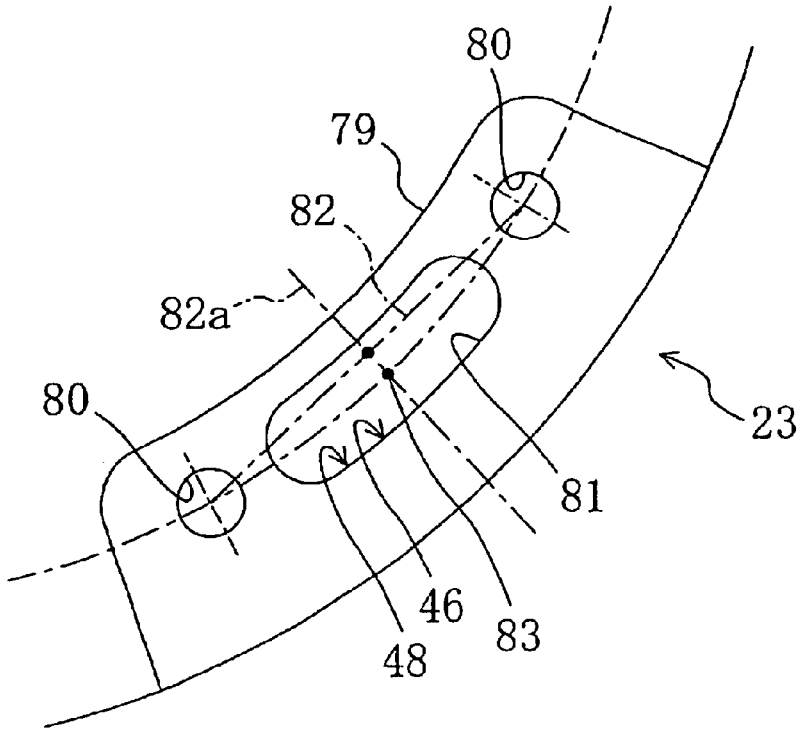
FIG. 8 is a partially enlarged view showing a positional relationship between fastening apertures and an upper end opening of a scroll side passageway in a housing fixing part in a first modification example of the first embodiment.

In the high-low pressure dome type compressor (1) according to the first embodiment, of the fastening apertures (80) to which the bolts (38) for fastening of the fixed scroll (24) to the housing (23) are threadedly engaged, fastening apertures (80) adjacent to both casing circumferential-direction sides of the connection passageway (46) are formed such that the center of the straight line (82) connecting together the centers of the fastening apertures (80) corresponds to the center (83) of the connection passageway (46). Alternatively, in a first modification example of the first embodiment, it is arranged such that the center of the straight line (82) connecting together the centers of the fastening apertures (80) lies within the connection passageway (46), as shown in FIG. 8.

In other words, the upper end opening (81) of the housing side passageway (48) constituting the connection passageway (46) is shaped like a circular arc which is elongated relative to the circumferential direction of the casing (10). Besides, the center (83) of the connection passageway (46) and each of the centers of the fastening apertures (80) on both casing circumferential-direction sides of the connection passageway (46) are so arranged to be lie on the same circumference. And, the straight line (82) connecting together the centers of the fastening apertures (80) adjacent to both circumferential sides of the upper end opening (81) and the straight line (82*a*) passing through the center (83) of the connection passageway (46) (the center (83) of the upper end opening (81)) and extending in a radial direction intersect with each other within the upper end opening (81).

Stated another way, the upper end opening (81) of the housing side passageway (48) constituting the connection passageway (46) is shaped like a circular arc having such a circumferential length that the distance between two fastening apertures (80) adjacent to both casing circumferential-direction sides of the upper end opening (81) does not expand excessively. That is to say, in order to gain refrigerant flow rate, it is desirable that the circumferential length of the connection passageway (46) is extended. However, if extended too much, the distance between the fastening apertures (80) will expand excessively, and there is a worry that sealability falls. To cope with this, the connection passageway (46) and the fastening apertures (80) are formed such that the center of the straight line (82) connecting together the centers of two fastening apertures (80) adjacent to both sides of the upper end opening (81) lies in the inside of the connection passageway (46) (i.e., in the inside of the upper end opening (81) of the housing side passageway (48)).

Even when the connection passageway (46) and the fastening apertures (80) are formed in the way as described above, airtightness between the fixed scroll (24) and the housing (23) is maintained. Furthermore, sealing between the high-level pressure space (28) and the low-level pressure space (29) is ensured, thereby preventing leakage of high-pressure refrigerant in the connection passageway (46) to the low-level pressure space (29) without fail. Other arrangements, working, and effects are the same as stated in the first embodiment.

MODIFICATION EXAMPLE 2

Figure 9:
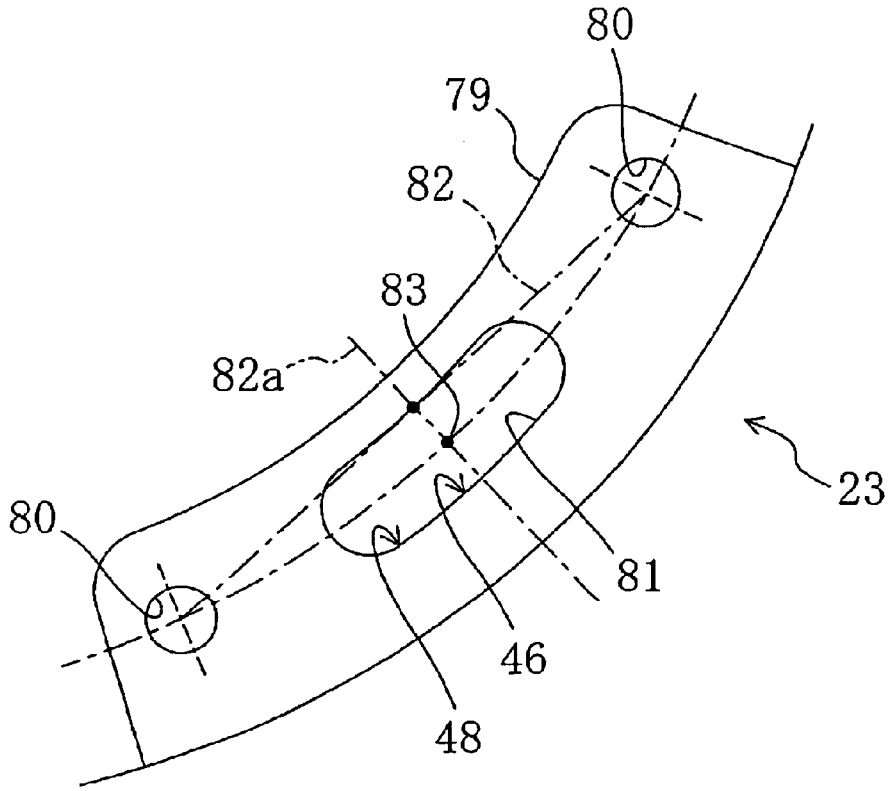
FIG. 9 is a partially enlarged view showing a positional relationship between fastening apertures and an upper end opening of a scroll side passageway in a housing fixing part in a second modification example of the first embodiment.

In a second modification example of the first embodiment, the connection passageway (46) and the fastening apertures (80) are formed employing a different arrangement from the first modification example in that the center of the straight line (82) connecting together the centers of the fastening apertures (80) lies at a radial-direction internal end of the connection passageway (46), as shown in FIG. 9.

To sum up, the upper end opening (81) of the housing side passageway (48) constituting the connection passageway (46) is shaped like a circular arc which is elongated relative to the circumferential direction of the casing (10). Furthermore, the center (83) of the connection passageway (46) and each of the centers of the fastening apertures (80) adjacent to both casing circumferential-direction sides of the connection passageway (46) are so arranged as to lie on the same circumference. And, the straight line (82) connecting together the centers of the fastening apertures (80) adjacent to the both circumferential-direction sides of the upper end opening (81) and the straight line (82*a*) passing through the center (83) of the connection passageway (46) (the center (83) of the upper end opening (81)) and extending in a radial direction intersect with each other at a radial-direction internal end of the connection passageway (46) (i.e., the upper end opening (81) of the housing side passageway (48)) so as to come into contact with the upper end opening (81).

Even when the connection passageway (46) and the fastening apertures (80) are formed in the way as described above, airtightness between the fixed scroll (24) and the housing (23) is maintained. Furthermore, sealing between the high-level pressure space (28) and the low-level pressure space (29) is ensured, thereby preventing leakage of high-pressure refrigerant in the connection passageway (46) to the low-level pressure space (29) without fail. Other arrangements, working, and effects are the same as stated in the first embodiment.

Embodiment 2

Figure 10A:
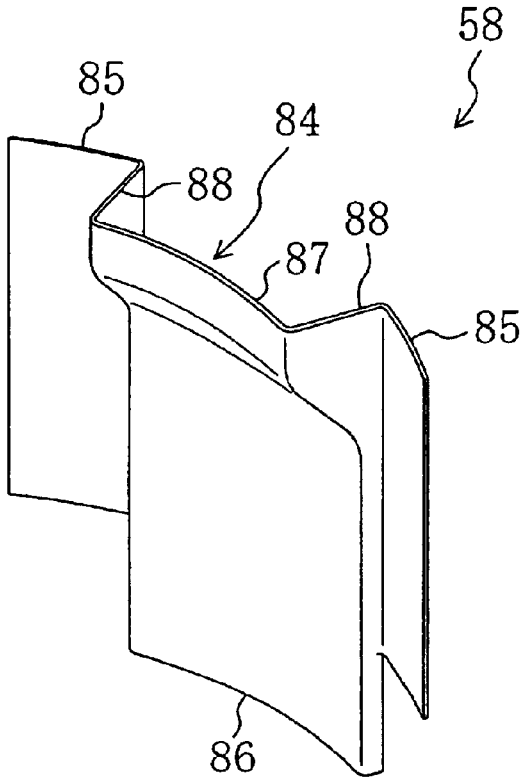
FIG. 10A is a perspective diagram when viewed from the front side and FIG. 10B is a perspective diagram when viewed from the rear side.
Figure 10B:
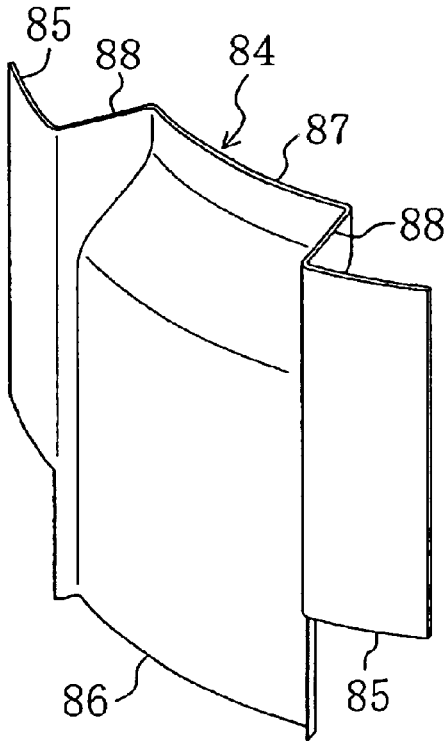

In the guide plate (58) disposed in the high-low pressure dome type compressor (1) according to a second embodiment of the present invention, the provision of the flow dividing concave portion (90) is omitted, as shown in FIG. 10. Here, the same reference numerals have been applied to the same component parts as in the first embodiment and their description is omitted.

More specifically, the guide plate (58) of the second embodiment is comprised of the guide main body (84) and the winglike parts (85) disposed at both ends of the guide main body (84). The guide main body (84) comprises the lower curved plate (86) having a transverse cross section shaped like a circular arc and extending linearly in an up-and down direction and the protruding part (87) connected to an upper end of the lower curved plate (86) and formed so as to flare more toward the inner periphery as closer to its upper end, and the side wall part (88) formed vertically toward the outer peripheral side at both ends of the lower curved plate (86) and the protruding part (87).

The winglike parts (85) are joined to outer peripheral side ends of the side wall part (88) of the guide main body (84) and are so formed as to have a transverse cross section shaped like a circular arc and to extend linearly in an up-and-down direction. Unlike the first embodiment, in the winglike part (85) of the second embodiment its lower end is positioned at an intermediate height of the lower curved plate (86) of the guide main body (84).

The drive motor (16) is formed for example by an induction motor.

Accordingly, refrigerant, which has flowed through the connection passageway (46) and flowed out into the clearance space (18) from the discharge opening (49), flows downward between the guide main body (84) of the guide plate (58) and the inner surface of the casing main body (11). And, all the refrigerant flows downward through the motor cooling passageway (55) to a lower space of the motor where its flow direction is reversed. Then, the refrigerant flows upward through an air gap passageway between the stator (51) and the rotor (52) or through the motor cooling passageway (55) opposite to the connection passageway (46). Thereafter, the refrigerant flows into the discharge pipe (20) from the internal end (36) of the discharge pipe (20) and is discharged outside the casing (10).

In accordance with the high-low pressure dome type compressor (1) of the second embodiment, it is arranged such that all the refrigerant which has flowed out into the clearance space (18) flows into the motor cooling passageway (55). As a result of such arrangement, the drive motor (16) is cooled efficiently without fail in comparison with the high-low pressure dome type compressor (1) according to the first embodiment.

Other arrangements, working, and effects are the same as in the first embodiment.

Other Embodiments

As to the foregoing embodiments, the compression mechanism (15) is not limited to a scroll type. For example, the compression mechanism (15) may be formed into a rotary piston type.

Further, as to the foregoing embodiments, the muffler space (45) in the compression mechanism (15) may be omitted.

Furthermore, as to first embodiment, the guide plate (58) may be omitted. Moreover, as to the first embodiment, the drive motor (16) is not limited to a DC motor. The drive motor (16) may be implemented by an AC motor.

Besides, as to the second embodiment, the internal end (36) of the discharge pipe (20) is not limited to the foregoing construction in which it projects inward beyond the inner surface of the casing main body (11).

Moreover, in each of the foregoing embodiments the connection passageway (46) has a transverse cross section shaped like a circular arc which is elongated relative to the circumferential direction of the casing. Alternatively, the connection passageway (46) may have a circular transverse cross section.

INDUSTRIAL APPLICABILITY

As has been described above, the present invention provides a high-low pressure dome type compressor which is useful when employed in a refrigerant circuit or the like, particularly when disposed in a small space.

What is claimed is:

1. A high-low pressure dome type compressor comprising:

a casing having a compression mechanism and an internal space that is divided into high-level and low-level pressure spaces facing each other across said compression mechanism;

a drive motor drivingly connected to said compression mechanism and disposed in said high-level pressure space;

a discharge pipe through which working fluid in said high-level pressure space is discharged outside said casing being disposed at an end of said drive motor that is adjacent to said compression mechanism;

a connection passageway formed in said compression mechanism, through which working fluid compressed in a compression chamber of said compression mechanism flows out into a clearance space defined between said compression mechanism and said drive motor; and a motor cooling passageway formed between said drive motor and an inner surface area of said casing, through which working fluid which has flowed out of said connection passageway circulates between said clearance space and a side of said drive motor which is opposite to said compression mechanism.

2. The high-low pressure dome type compressor of claim 1, wherein said compression mechanism is provided with a muffler space which is formed between said compression chamber and said connection passageway.

3. A high-low pressure dome type compressor claim 1, wherein said compression mechanism comprises a fixed scroll and a housing member that houses a movable scroll which matingly engages with said fixed scroll, and said housing member is hermetically joined to an inner surface area of said casing over an entire circumferential periphery thereof.

4. The high-low pressure dome type compressor of claim 3, wherein said connection passageway is so formed as to have a transverse cross section shaped like a circular arc.

5. The high-low pressure dome type compressor of claim 2, wherein said compression mechanism comprises a fixed scroll and a housing member that houses a movable scroll which matingly engages with said fixed scroll, and said housing member is hermetically joined to an inner surface area of said casing over an entire circumferential periphery thereof.

6. A high-low pressure dome type compressor comprising:

a casing having a compression mechanism and an internal space that is divided into high-level and low-level pressure spaces facing each other across said compression mechanism;

a drive motor drivingly connected to said compression mechanism and disposed in said high-level pressure space;

a connection passageway formed in said compression mechanism, through which working fluid compressed in a compression chamber of said compression mechanism flows out into a clearance space defined between said compression mechanism and said drive motor;

a motor cooling passageway formed between said drive motor and an inner surface area of said casing, through which working fluid which has flowed out of said connection passageway circulates between said clearance space and a side of said drive motor which is opposite to said compression mechanism; and a guide plate that is disposed in said clearance space and configured to guide working fluid which has flowed out of said connection passageway to said motor cooling passageway.

7. The high-low pressure dome type compressor of claim 6, wherein said casing is provided with a discharge pipe through which working fluid in said high-level pressure space is discharged outside said casing, and said guide plate is provided with a flow dividing portion configured to distribute a part of working fluid flowing toward said motor cooling passageway in a circumferential direction and guide said distributed working fluid to an internal end of said discharge pipe that is located in said clearance space.

8. The high-low pressure dome type compressor of claim 7, wherein said internal end of said discharge pipe projects inward beyond an inner surface area of said casing.

9. The high-low pressure dome type compressor of claim 6, wherein said compression mechanism comprises a fixed scroll and a housing member that houses a movable scroll which matingly engages with said fixed scroll, and said housing member is hermetically joined to an inner surface area of said casing over an entire circumferential periphery thereof.

10. The high-low pressure dome type compressor of claim 9, wherein said connection passageway is so formed as to extend from said fixed scroll to said housing member, said fixed scroll and said housing member having at least first and second fastening apertures with bolts disposed therein that fasten said fixed scroll and said housing member together, and said connection passageway and said first and second fastening apertures that are adjacent to first and second casing circumferential-direction sides of said connection passageway, respectively, are formed such that a center of a straight line connecting together centers of said first and second fastening apertures lies within said connection passageway in a joint surface between said fixed scroll and said housing member.

11. The high-low pressure dome type compressor of claim 10, wherein said connection passageway and said first and second fastening apertures adjacent to said first and second casing circumferential-direction sides of said connection passageway, respectively, are formed such that the center of the straight line connecting together the centers of said first and second fastening apertures corresponds to a center of said connection passageway in said joint surface between said fixed scroll and said housing member.

12. A high-low pressure dome type compressor comprising:

a casing having a compression mechanism and an internal space that is divided into high-level and low-level pressure spaces facing each other across said compression mechanism, said compression mechanism comprises a fixed scroll and a housing member that houses a movable scroll which matingly engages with said fixed scroll, said housing member is hermetically joined to an inner surface area of said casing over an entire circumferential periphery thereof;

a drive motor drivingly connected to said compression mechanism and disposed in said high-level pressure space;

a connection passageway formed in said compression mechanism, through which working fluid compressed in a compression chamber of said compression mechanism flows out into a clearance space defined between said compression mechanism and said drive motor; and a motor cooling passageway formed between said drive motor and an inner surface area of said casing, through which working fluid which has flowed out of said connection passageway circulates between said clearance space and a side of said drive motor which is opposite to said compression mechanism, said connection passageway is so formed as to extend from said fixed scroll to said housing member, said fixed scroll and said housing member having at least first and second fastening apertures with bolts disposed therein that fasten said fixed scroll and said housing member together, and said connection passageway and said first and second fastening apertures that are adjacent to first and second casing circumferential-direction sides of said connection passageway, respectively, are formed such that a center of a straight line connecting together centers of said first and second fastening apertures lies within said connection passageway in a joint surface between said fixed scroll and said housing member.

13. The high-low pressure dome type compressor of claim 12, wherein said connection passageway and said first and second fastening apertures adjacent to said first and second casing circumferential-direction sides of said connection passageway, respectively, are formed such that the center of the straight line connecting together the centers of said first and second fastening apertures corresponds to a center of said connection passageway in said joint surface between said fixed scroll and said housing member.

14. A high-low pressure dome type compressor comprising:

a casing having a compression mechanism and an internal space that is divided into high-level and low-level pressure spaces facing each other across said compression mechanism;

a drive motor drivingly connected to said compression mechanism and disposed in said high-level pressure space;

a connection passageway formed in said compression mechanism, through which working fluid compressed in a compression chamber of said compression mechanism flows out into a clearance space defined between said compression mechanism and said drive motor;

a motor cooling passageway formed between said drive motor and an inner surface area of said casing, through which working fluid which has flowed out of said connection passageway circulates between said clearance space and a side of said drive motor which is opposite to said compression mechanism; and a guide plate that is disposed in said clearance space and configured to guide working fluid which has flowed out of said connection passageway to said motor cooling passageway, said compression mechanism is provided with a muffler space which is formed between said compression chamber and said connection passageway.

15. The high-low pressure dome type compressor of claim 14, wherein said casing is provided with a discharge pipe through which working fluid in said high-level pressure space is discharged outside said casing, and said guide plate is provided with a flow dividing portion configured to distribute a part of working fluid flowing toward said motor cooling passageway in a circumferential direction and guide said distributed working fluid to an internal end of said discharge pipe that is located in said clearance space.

16. The high-low pressure dome type compressor of claim 15, wherein said internal end of said discharge pipe projects inward beyond an inner surface area of said casing.

17. The high-low pressure dome type compressor of claim 16, wherein said compression mechanism comprises a fixed scroll and a housing member that houses a movable scroll which matingly engages with said fixed scroll, and said housing member is hermetically joined to an inner surface area of said casing over an entire circumferential periphery thereof.

18. The high-low pressure dome type compressor of claim 17, wherein said connection passageway is so formed as to have a transverse cross section shaped like a circular arc.

19. The high-low pressure dome type compressor of claim 18, wherein said connection passageway is so formed as to extend from said fixed scroll to said housing member, said fixed scroll and said housing member having at least first and second fastening apertures with bolts disposed therein that fasten said fixed scroll and said housing member together, and said connection passageway and said first and second fastening apertures that are adjacent to first and second casing circumferential-direction sides of said connection passageway, respectively, are formed such that a center of a straight line connecting together centers of said first and second fastening apertures lies within said connection passageway in a joint surface between said fixed scroll and said housing member.

20. The high-low pressure dome type compressor of claim 19, wherein said connection passageway and said first and second fastening apertures adjacent to said first and second casing circumferential-direction sides of said connection passageway, respectively, are formed such that the center of the straight line connecting together the centers of said first and second fastening apertures corresponds to a center of said connection passageway in said joint surface between said fixed scroll and said housing member.

21. A high-low pressure dome type compressor comprising:

a casing having a compression mechanism and an internal space that is divided into a high-level pressure space on a lower side of said compression mechanism and a low-level pressure space on an upper side of said compression mechanism, said high-level and low-level pressure spaces facing each other across said compression mechanism;

a drive motor drivingly connected to said compression mechanism and disposed in said high-level pressure space;

a discharge pipe through which working fluid in said high-level pressure space is discharged outside said casing being disposed between said drive motor and said compression mechanism;

a connection passageway formed in said compression mechanism, through which working fluid compressed in a compression chamber of said compression mechanism flows out into a clearance space defined between said compression mechanism and said drive motor; a motor cooling passageways formed, in order to allow working fluid to flow to a lower part of said casing, between said drive motor and an inner surface area of said casing, through which working fluid which has flowed out of said connection passageway flows between said clearance space and a lower side of said drive motor.

22. The high-low pressure dome type compressor of claim 21, wherein said compression mechanism is provided with a muffler space which is formed between said compression chamber and said connection passageway.

* * * * *